US007033143B2

(12) United States Patent
Mead et al.

(10) Patent No.: US 7,033,143 B2
(45) Date of Patent: Apr. 25, 2006

(54) PUMPING SYSTEM WITH CLUTCH AND ASSOCIATED BY-PASS

(75) Inventors: Colin Andrew Mead, Dorchester (GB); Alan Thomas Parsons, Dorchester (GB); Stephen Arthur Pointer, Dorchester (GB); Mark Arwyn Bennett, Guildford (GB)

(73) Assignee: QinetiQ Limited, (GB)

( * ) Notice: Subject to any disclaimer, the term of this patent is extended or adjusted under 35 U.S.C. 154(b) by 231 days.

(21) Appl. No.: 10/476,822

(22) PCT Filed: May 13, 2002

(86) PCT No.: PCT/GB02/02126

§ 371 (c)(1),
(2), (4) Date: Nov. 3, 2003

(87) PCT Pub. No.: WO02/093012

PCT Pub. Date: Nov. 21, 2002

(65) Prior Publication Data

US 2004/0131474 A1 Jul. 8, 2004

(30) Foreign Application Priority Data

May 15, 2001 (GB) ..... 0111823

(51) Int. Cl.
*F04B 49/00* (2006.01)
*F04B 1/26* (2006.01)

(52) U.S. Cl. ..... 417/223; 417/270; 417/319; 417/440; 417/490

(58) Field of Classification Search ..... 417/269–273, 417/223, 319, 440, 490–501; 91/499, 472, 91/507; 92/61–76, 71, 74; 137/533.11
See application file for complete search history.

(56) References Cited

U.S. PATENT DOCUMENTS 6,179,574 B1 * 1/2001 Yie ..... 417/269

FOREIGN PATENT DOCUMENTS

| | | |
|---|---|---|
| GB | 924674 | 5/1963 |
| WO | WO 99/01338 | 1/1999 |

* cited by examiner

*Primary Examiner*—Charles G. Freay
*Assistant Examiner*—Vikansha Dwivedi
(74) *Attorney, Agent, or Firm*—McDonnell Boehnen; Hulbert & Berghoff LLP

(57) ABSTRACT

This invention relates to a pumping system. The design of the system is such that bi-directional operation can be achieved using a significantly smaller and hence lighter unit than those currently available. It uses the direction of rotation of the drive shaft to control the opening and closure of the by-pass means for controllably returning the fluid to the first reservoir.

10 Claims, 4 Drawing Sheets

PUMPING SYSTEM WITH CLUTCH AND ASSOCIATED BY-PASS

This invention relates to a pumping system

Conventionally, pumping systsms designed for two way operation have a fluid return channel to allow fluid to flow back from one fluid store to another. Generally, the return channel and the pump are controlled independently. An example of a control mechanism for a return channel is a solenoid valve, the size of which can be comparable to that of the motor. The disadvantage of this arrangement is that incorporation of such a return channel and associated control mechanism greatly increases the size and weight of the pump.

According to the present invention, a pumping system comprises a first reservoir and a second reservoir; a motor coupled to a drive shaft; a pump, driven by the drive shaft, for pumping fluid from the first reservoir to the second reservoir; and by-pass means for controllably returning fluid from the second reservoir to the first reservoir; characterised by a clutch between the drive shaft and the by-pass means whereby rotation of the drive shaft in a first direction drives the pump and disengages the clutch while the by-pass means is closed, and rotation of the drive shaft in a second direction engages the clutch so that the by-pass means is opened.

In the present invention, the by-pass means operates under control of the drive shaft, thereby removing the need for separate control components and so reducing the size and weight or the pumping system.

When rotating the drive shaft in the first direction of rotation, closing the by-pass means when driving the pump maximises the net rate of fluid transfer between the first reservoir and the second reservoir whilst rotation in the second direction allows return of the fluid from the second reservoir to the first reservoir. This arrangement is particularly convenient given that motors often exhibit greater torque and power characteristics in one direction of rotation compared to the other.

Preferably, the by-pass means is adapted to be closed when the motor is idle.

This allows fluid in the second reservoir to be maintained at a higher pressure than fluid in first reservoir when the motor is idle.

Preferably, the by-pass means comprises a by pass valve.

Preferably, the by-pass means comprises a cam-follower and a cam; wherein the clutch is operative between the drive shaft and the cam; and whereby opening and closure of the by-pass means is controlled by engagement of the cam-follower with the cam and rotation of the drive shaft.

Preferably, the cam comprises an end stop, whereby rotation of the drive shaft in the second direction causes the end stop to reach the cam-follower after the by-pass means is opened, thereby restraining the cam.

In a preferred embodiment, the clutch comprises a flexible resilient sleeve attached to the drive shaft and adapted to grip a shaft operatively associated with the by-pass means when the drive shaft Is rotated in the second direction; and whereby rotation of the drive shaft in the first direction causes the sleeve to loosen from the second-mentioned shaft. Conveniently, the flexible resilient sleeve comprises a spring.

Alternatively, the clutch comprises two clutch plates; wherein each clutch plate comprises bevelled teeth; wherein one clutch plate is sprung loaded; whereby rotation of the drive shaft in the first direction allows the bevelled teeth to pass over each other; and whereby rotation of the drive shaft in the second direction causes the bevelled teeth to mesh.

Preferably, the by-pass means is housed within the pump.

Preferably, the pump comprises a swash plate pump.

One benefit of a swash plate pump is that it uses a single way valve, so nothing leaks back to the first reservoir when the motor stops rotating. Nor is a gearbox required on the Motor, so reducing the size and noise generated in operation.

An example of a pumping system according to the invention will now be described with references to the accompanying drawings in which.

FIG. 6 showes an alternative clutch arrangement.

Figure 1:
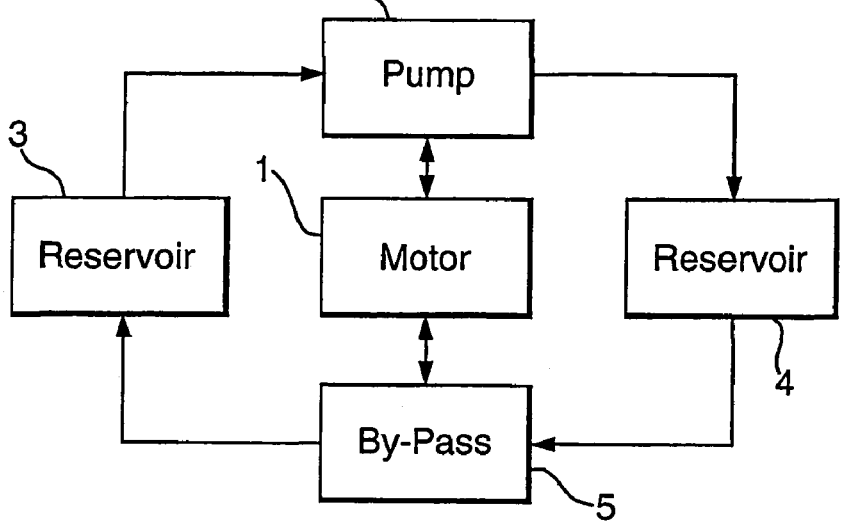
FIG. 1 illustrates, schematically, a pumping system according to the present invention.

FIG. 1 illustrates, schematically, a pumping system according to the invention. A motor 1 is coupled to and drives a pump 2 which pumps fluid from a fist reservoir 3 to a second reservoir 4. A by-pass mechanism 5 controls the return of fluid from the second reservoir to the first reservoir, when motor rotation is reversed, assuming higher pressure in the second reservoir.

Figure 2:
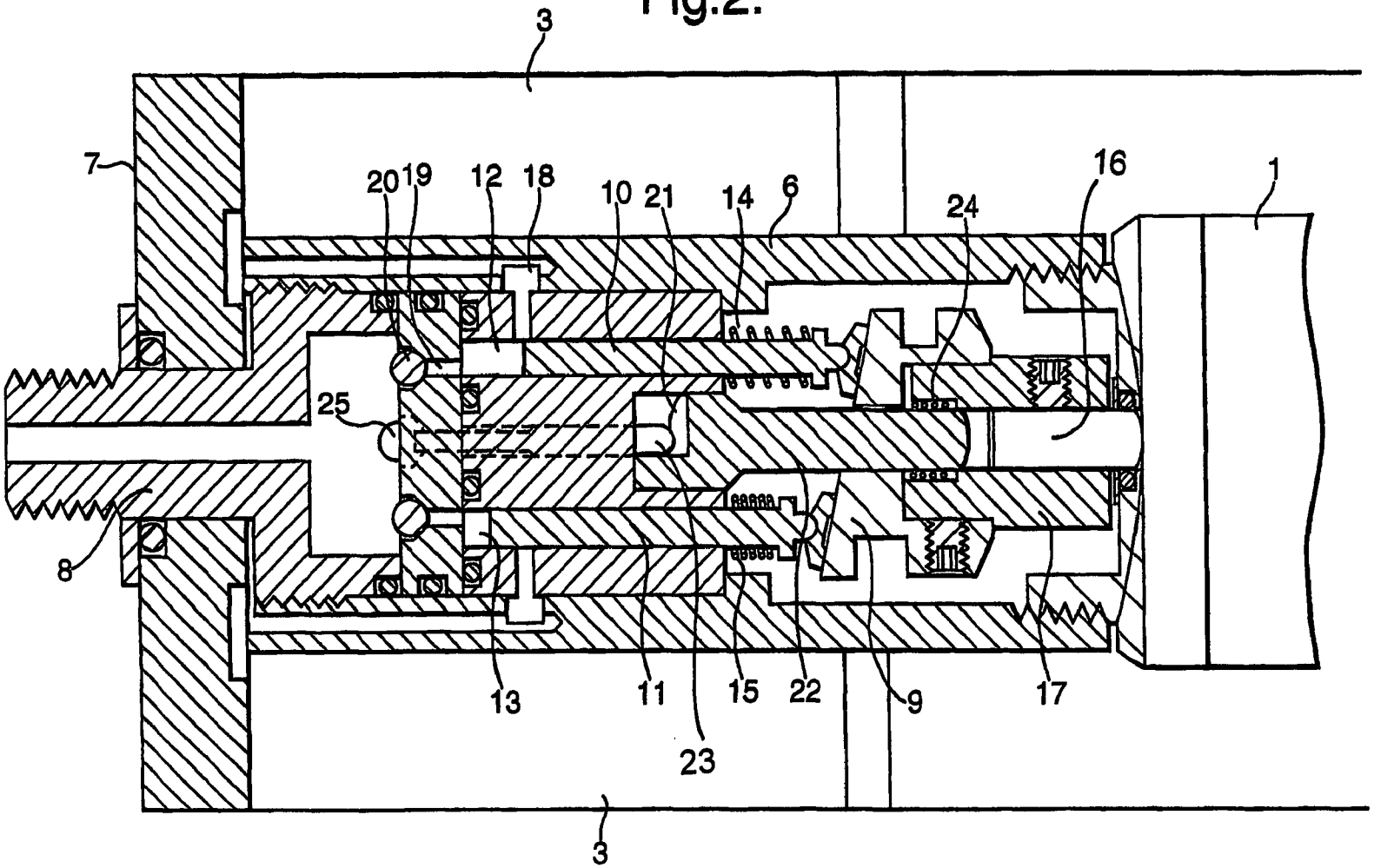
FIG. 2 illustrates the pumping system of FIG. 1 in more detail.

FIG. 2 shows the pumping system of FIG. 1 in more detail. An outer housing 6 of the pumping system is attached to a bulkhead 7 by a threaded mounting spigot 8 and a nut (not shown). The first reservoir 3 is provided outside the housing 6 and fluid flows between the first reservoir and the second reservoir 4 via an orifice in the threaded mounted spigot 8. The housing 6 contains the pump and the by-pass mechanism. The pump comprises a swash plate 9 and two pistons 10, 11 that run in two cylinders 12, 13. The swash plate engages the two pistons which move within their respective cylinders. The swash plate engages both pistons at diametrically opposed positions on the swash plate and each piston is held against the swash plate by a spring 14, 15 respectively.

The motor 1 is attached to the housing 6. The motor is coupled to a drive shaft. 16 which in turn is coupled to the swash plate 9 via a coupling 17. The motor drives the swash plate which cause both pistons 10, 11 to oscillate within their respective cylinders 12, 13.

Figure 3:
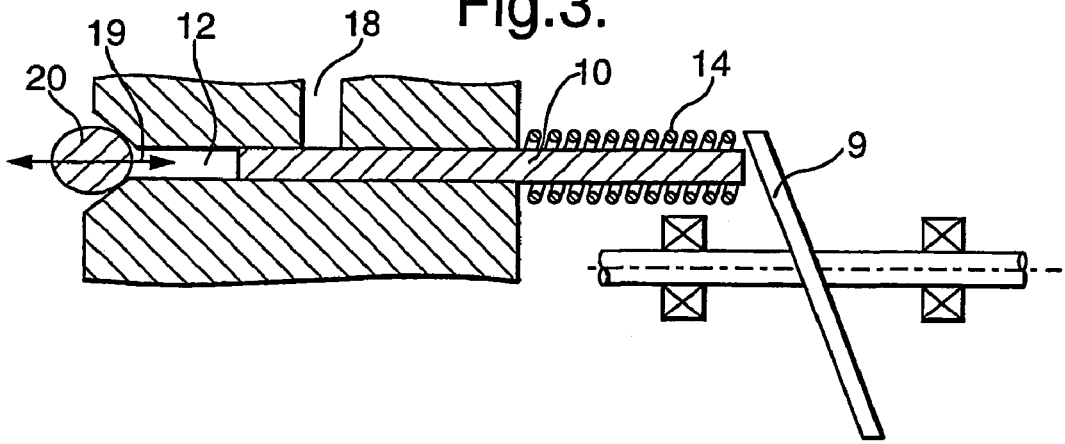
FIGS. 3 and 4 illustrate the motion of a piston within its respective cylinder in the pumping system of FIG. 1.
Figure 4:
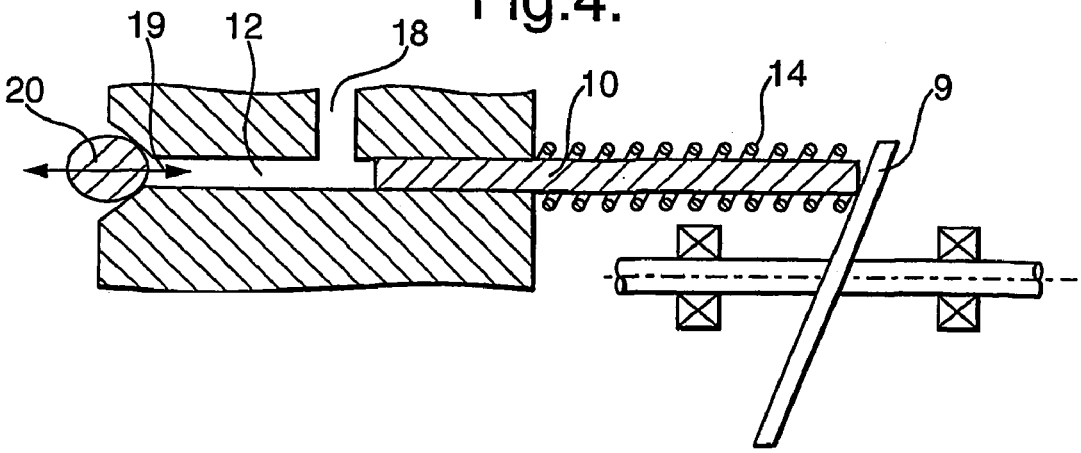

FIGS. 3 and 4 show the motion of the piston 10 Within its respective cylinder 12, FIG. 3 shows an extreme of oscillation, the engaged position, where the piston is, as far as possible, driven in to the cylinder by the swash plate 9. FIG. 4 shows the other extreme of oscillation, the disengaged position, where the piston is, as far as possible, driven out of the cylinder by the spring 14 acting against the piston.

From the disengaged position, movement of the piston 10 towards the engaged position causes the piston to compress fluid within the cylinder 12, the fluid having been received from the first reservoir 3 via an inlet 18. Once the piston has moved past the inlet, the fluid within the cylinder is discharged to the second reservoir 4, via an outlet 19 and a non-return valve 20. From the engaged position, movement of the piston towards the disengaged position, whereby the position is withdrawn past the inlet, allows the cylinder 12 to re-fill with fluid received from the first reservoir. Continuous rotation of the swash plate 9 causes repetition of the engaged and disengaged piston cycle, thereby producing fluid flow from the first reservoir to the second reservoir.

Figure 5C:
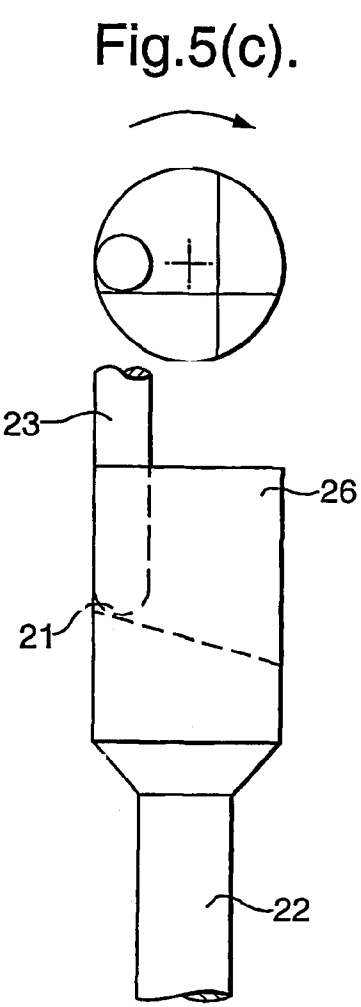
FIG. 5 illustrates by-pass actuation in the example of FIG. 1.

FIG. 5 illustrates actuation of the by-pass mechanism in the pumping system according to the invention. The by-pass 5 comprises a cam 21, a cam shaft 22, a cam follower 23, a spring clutch 24 and a by-pass valve 95. The by-pass valve is coupled to the cam-follower which engages the cam. Rotation of the cam in a first direction of rotation causes the by-pass valve to close thereby preventing transfer of fluid from the second reservoir 4 to the first reservoir 3. Rotation of the cam in a second direction of rotation allows return of the fluid from the second reservoir to the first reservoir.

The camshaft 22 is coupled to the drive shaft 16 via a spring clutch 24. Rotation of the motor 1 in the first direction causes the spring clutch to unwind, causing it to loosen its grip on the camshaft.

Figure 5B:
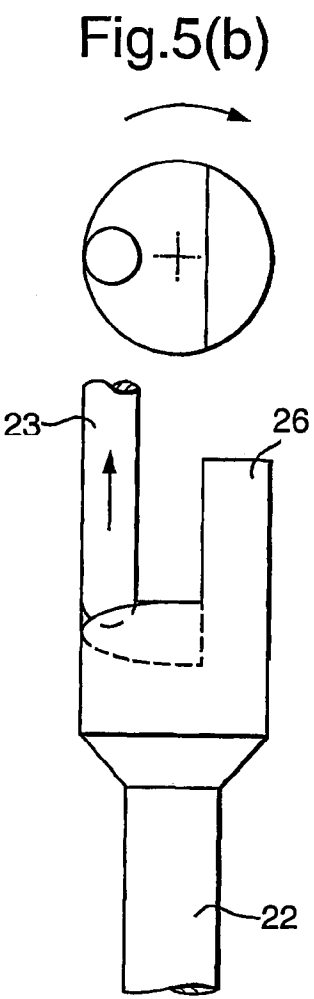
Figure 5A:
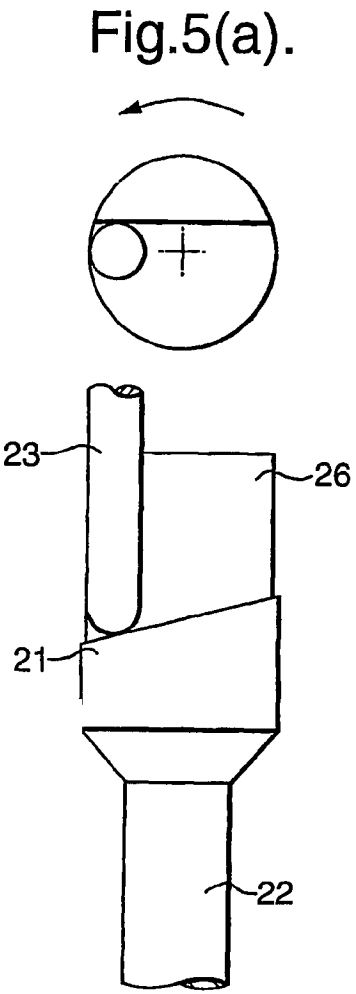

In FIG. 5*a*, initial rotation of the motor 1 in the first direction of rotation causes the cam 21 to rotate such that the cam follower 23 is retracted and the by-pass valve 25 is closed. Further rotation of the motor in the first direction causes the spring clutch 24 to disengage whereby the cam and camshaft 22 are restrained by an end stop 26, and continued rotation of the motor is substantially unrestricted.

In FIG. 5*b*, rotation of the motor 1 in the second direction of rotation causes the spring clutch 24 to engage the camshaft 22, thereby rotating the cam 21. This causes the cam-follower 23 to adapt and, as a consequence, open the by-pass valve allowing fluid to flow back from the second reservoir 4 to the first reservoir 3. The valve remains open until pump rotation is reversed.

In one example of a system according to the invention, the overall dimensions were 22 mm diameter and 62 mm length. The hydraulic fluid used was 10W40 motor oil which was pumped at up to 30 ml per minute at pressures of 48.3 Bar (4.8 $MN/m^2$ or 700 psi).

Figure 6B:
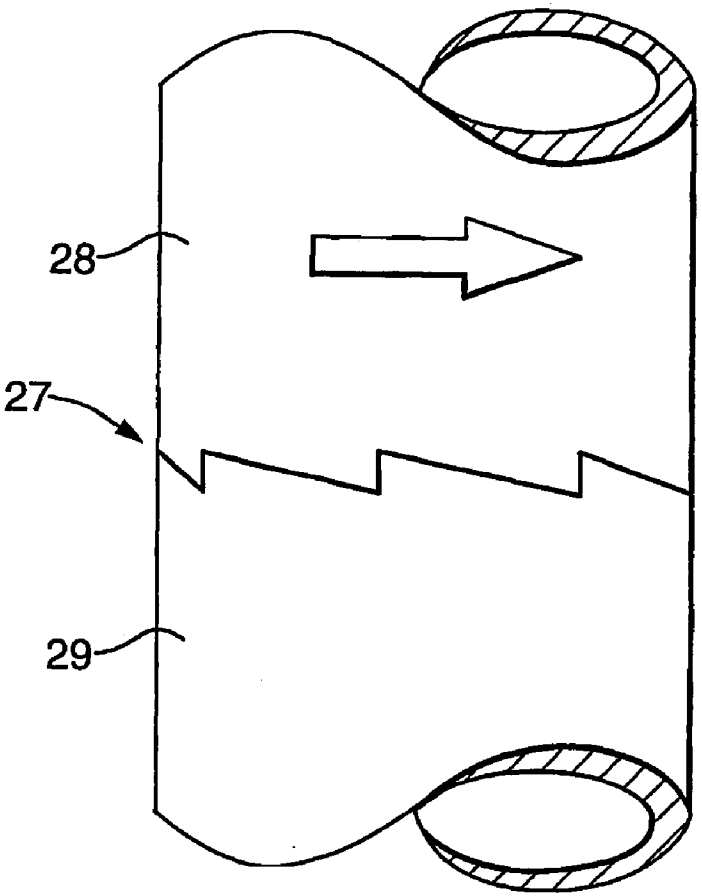
Figure 6A:
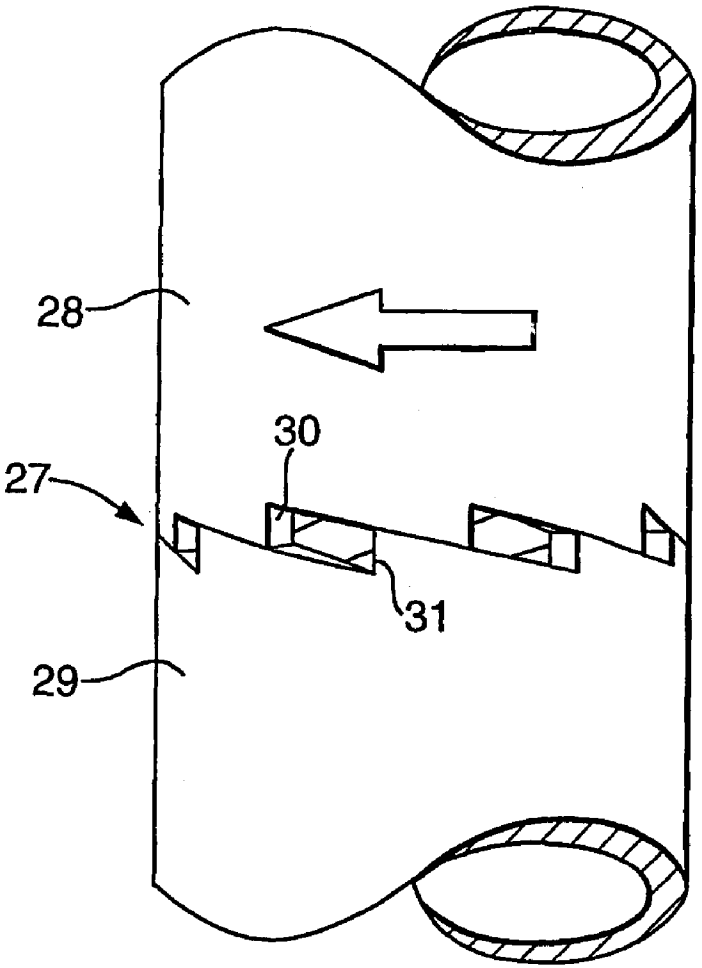

FIGS. 6*a* and 6*b* show an alternative clutch arrangement which may be used instead of the spring clutch 24. The alterative clutch 27 comprises two clutch plates 28, 29, both of which have bevelled teeth 30, 31. The clutch plates are urged together, preferably by spring loading (not shown). FIG. 6*a* shows the operation of the alternative clutch 27 corresponding to rotation of the motor 1 in the first direction of rotation. The bevelled teeth 30, 31 do not engage each other, instead they react against the urging force between the clutch plates 28, 27 and allow the clutch plates to run over each other.

FIG. 6*b* shows the operation of the alterative clutch 27 corresponding to rotation of the motor 1 in thet second direction of rotation. Such rotation causes the bevelled teeth 30, 31 to engage, thereby preventing relative motion between the two clutch plates 28, 29.

What is claimed is:

1. A pumping system comprising a first reservoir and a second reservoir; a motor coupled to a drive shaft; a pump, driven by the drive shaft for pumping fluid from the first reservoir to the second reservoir; a by-pass for controllably returning fluid from the second reservoir to the first reservoir; and a clutch between the drive shaft and the by-pass whereby rotation of the drive shaft in a first direction drives the pump and disengages the clutch while the by-pass is closed, and rotation of the drive shaft in a second direction engages the clutch so that the by-pass is opened.

2. A system according to claim 1, wherein the by-pass is adapted to be closed when the motor is idle.

3. A system according to claim 1 wherein the by-pass comprises a by-pass valve.

4. A system according to claim 1, wherein the by-pass comprises a cam-follower and a cam; wherein the clutch is operative between the drive shaft and the cam; and whereby opening and closure of the by-pass is controlled by engagement of the cam-follower with the cam and rotation of the drive shaft.

5. A system according to claim 4 wherein the cam comprises an end stop, whereby rotation of the drive shaft in the second direction causes the end stop to reach the cam-follower after the by-pass is opened, thereby restraining the cam.

6. A system according to claim 1, wherein the clutch comprises a flexible resilient sleeve attached to the drive shaft and adapted to grip a shaft operatively associated with the by-pass when the drive shaft is rotated in the second direction; and whereby rotation of the drive shaft in the first direction causes the sleeve to loosen from the second-mentioned shaft.

7. A system according to claim 6, wherein the flexible resilient sleeve comprises a spring.

8. A system according to claim 1 wherein the clutch comprises two clutch plates; wherein each clutch plate comprises bevelled teeth; wherein at least one clutch plate is sprung loaded; whereby rotation of the drive shaft in the first direction allows the bevelled teeth of said two clutch plates to pass over each other; and whereby rotation of the drive shaft in the second direction causes the bevelled teeth of said two clutch plates to mesh.

9. A system according to claim 1 wherein the by-pass is housed within the pump.

10. A system as claimed in claim 1 wherein the pump comprises a swash plate pump.

* * * * *